US005269138A

United States Patent [19]

Conete et al.

[11] Patent Number: 5,269,138

[45] Date of Patent: Dec. 14, 1993

[54] VARIABLE GEOMETRY FLAME TRAP DEVICE FOR USE IN AN AFTER-BURNER DEVICE OF A GAS TURBINE

[75] Inventors: Eric Conete, Le Mee sur Seine; Frédéric P. Eichstadt, Vaux le Penil; Gérard E. A. Jourdain, Saintry, all of France

[73] Assignee: Societe Nationale d'Etude et de Construction de Moteurs d'Aviation "SNECMA", Paris, France

[21] Appl. No.: 16,074

[22] Filed: Feb. 10, 1993

[30] Foreign Application Priority Data

Feb. 26, 1992 [FR] France ..... 92 02203

[51] Int. Cl.[5] ..... F02K 3/10

[52] U.S. Cl. ..... 60/261; 60/749

[58] Field of Search ..... 60/737, 738, 749, 261, 60/262, 264

[56] References Cited

U.S. PATENT DOCUMENTS

| | | | |
|---|---|---|---|
| 2,572,723 | 10/1951 | Hildestad | 60/749 |
| 2,696,709 | 12/1954 | Oulianoff | 60/261 |
| 2,800,765 | 7/1957 | French et al. | 60/264 |
| 2,835,108 | 5/1958 | Karen | 60/261 |
| 2,875,580 | 3/1959 | Moy et al. | 60/749 |
| 2,899,799 | 8/1959 | Setterblade | 60/261 |
| 2,908,136 | 10/1959 | Arnoldi | 60/749 |
| 2,936,585 | 5/1960 | Worsham et al. | 60/749 |
| 3,245,218 | 4/1966 | Marchant | 60/749 |
| 3,385,056 | 5/1968 | Forbes et al. | 60/261 |
| 3,701,255 | 10/1972 | Markowski | 60/261 |
| 4,134,260 | 1/1979 | Lefebvre et al. | 60/262 |

*Primary Examiner*—Richard A. Bertsch
*Assistant Examiner*—Timothy S. Thorpe
*Attorney, Agent, or Firm*—Oblon, Spivak, McClelland, Maier & Neustadt

[57] ABSTRACT

A variable geometry flame trap device for use in an after-burner device of a gas turbine, which is not exposed to deformation forces during its use in the after-burner mode. This is achieved with a plurality of flame trap plate pairs (21), positioned downstream of the turbine at the outlet of a primary air flow duct (9) and mounted so as to pivot on a plurality of diffuser arms (19) located at the outlet of a secondary air flow duct (7), characterized in that the plates (21) of each pair are made from a composite material and in that they have a cam projecting from their facing faces (42), said two cams (43) bearing on one another.

7 Claims, 3 Drawing Sheets

VARIABLE GEOMETRY FLAME TRAP DEVICE FOR USE IN AN AFTER-BURNER DEVICE OF A GAS TURBINE

DESCRIPTION

The invention relates to a variable geometry flame trap device for use in the after-burner device of a gas turbine, particularly in a turbo-jet equipping military fighters.

This type of turbo-jet comprises an after-burner or reheating chamber constituting a second burner or combustion chamber. The latter makes it possible to inject a second time thermal energy into the gases between the time when they pass out of the turbine and the time when they are ejected by a jet pipe.

Figure 1:
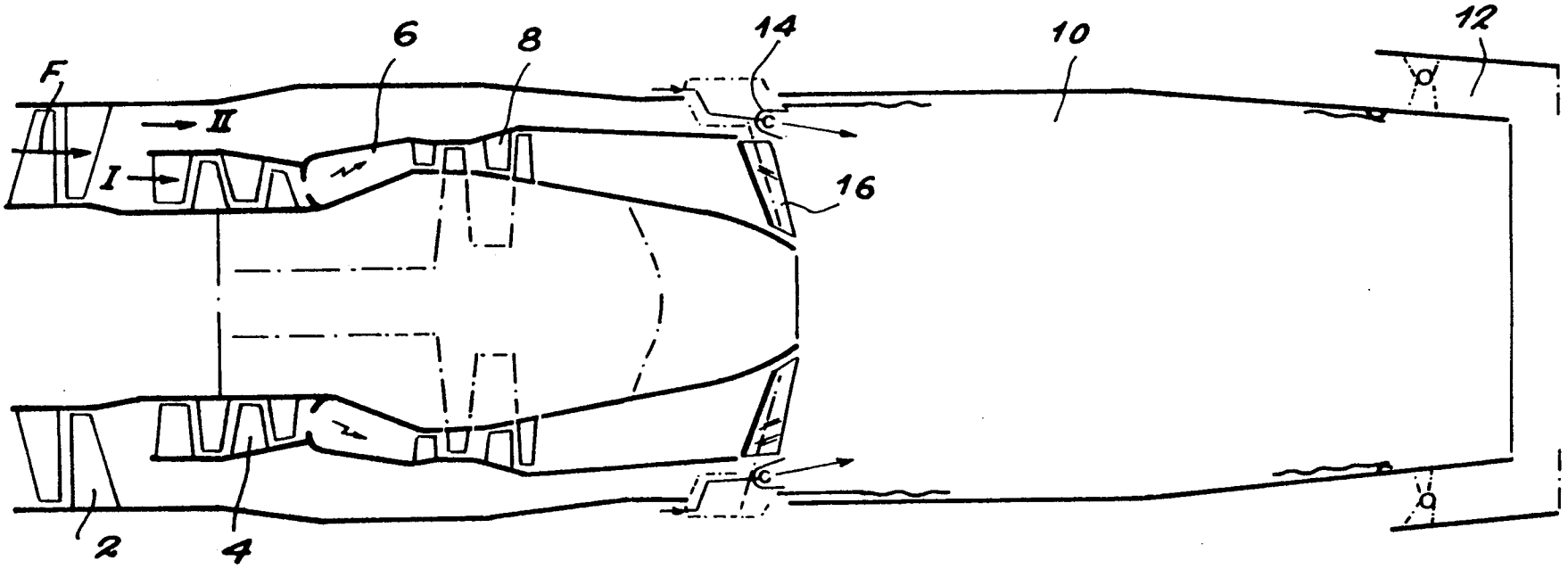

FIG. 1 illustrates a conventional turbo-jet equipped with an after-burner chamber and explains the operation of such a turbo-jet. A single air flow F enters the sir intake duct and traverses a low pressure compressor 2. The air is then subdivided into a primary flow I and a secondary flow II. The primary flow I successively traverses a high pressure compressor 4, a combustion chamber 6, a turbine 8, an after-burner chamber 10 and a variable section jet pipe 12. The secondary air flow II is used on the one hand for cooling the after-burner chamber 10 and on the other forms an unburned air supply to said after-burner chamber.

More specifically, the first combustion chamber 6 comprises a primary zone, where a supply takes place of only that air which is necessary for the combustion of the air-fuel mixture under stoichiometric conditions. Temperatures close to 2000° C. are then reached. The hot gases are then mixed with fresher air in a secondary zone (dilution zone), so as to reduce their temperature to an acceptable level for the turbine 8.

Thus, the gases from the combustion chamber 6 contain a certain amount of oxygen, which could possible have burnt three to four times more fuel. It is specifically this oxygen excess which will make it possible to burn the fuel supplied downstream to the after-burner chamber 10. Therefore the after-burner device makes it possible to increase the gas ejection speed and consequently increase the thrust of the turbo-jets.

Moreover, the after-burner device comprises a series of fuel injection systems 4 and flame trap devices 16 constituted by plates. The flame trap plates 16 create turbulence within the after-burner chamber 10 in order to increase the residence time of the air-fuel mixture within said chamber. Thus, combustion is stabilized and the efficiency levels obtained are higher.

As stated hereinbefore, the object of the after-burner chamber is to provide the aircraft with a supplementary thrust on the part of the turbo-jets. The fighter pilot will make his turbo-jet operate under after-burner conditions either on take-off, or in combat for escaping another aircraft. For the rest of the time the turbo-jet operates under "dry engine" conditions, i.e. there is no fuel supply and therefore no combustion in the after-burner chamber. Although flame trap plates are very useful during operation under after-burner conditions, they serve no useful purpose and even lead to pressure drops during dry engine operating conditions, as a result of their position in the after-burner chamber and their geometry. It is therefore necessary to produce variable geometry flame trap plates with a view to an optimum adaptation to different operating conditions.

French Patent 995,748 discloses flame stabilizers used in after-burner installations of a jet engine. These stabilizers are formed by a plate able to pivot about a shaft traversing the latter, so as to occupy a position perpendicular to the air flow in after-burner operation, or a position parallel to the air flow in dry engine operation. This document also describes stabilizers formed from two inwardly curved parts connected by their leading edges and able to open or close as a function of the operating conditions.

British Patent 1,245,673 discloses after-burner devices equipped with variable geometry flame plates constituted by two blades articulated about a central shaft and able to open during after-burner mode operation.

European patent application 94,296 of the present Applicant discloses a regulating device for moving vanes into the open and closed position in order to optimize the flight conditions by adjusting the ratios between the primary and secondary flows.

Devices are also known in the form of vanes, which are not flame plates, but which are made from a composite material and whose ends are fixed to metal parts optionally permitting the displacement thereof. Such arrangements are in particular described in French patent applications 2,312,673 and 2,522,362.

In most of the known after-burner devices, the flame trap plates are generally subject to very high aerodynamic forces, which tend to bend or even deform them. This problem is even greater in view of the fact that these plates are very often made from a ceramic composite material. Thus, these materials are used because they have a good resistance to very high temperatures and make it possible to produce flame trap plates with a much lower weight than in the case of metal plates. However, they are fragile. The forces are exerted not only on the actual plates made from such fragile materials, but also on their connections to the metal parts serving as a support and the setting control device.

The object of the invention is consequently to limit the disadvantages referred to hereinbefore and in particular reduce the bending stresses exerted on the flame trap plates.

To this end, the invention relates to a variable geometry flame trap device for use in the after-burner device of a gas turbine, comprising a plurality of regularly distributed diffuser arms placed at the outlet of a secondary air flow duct defined between an outer cylindrical casing and an inner cylindrical casing and a plurality of pairs of regularly distributed flame trap plates located at the outlet of a primary air flow duct defined between said inner casing and a central rear cone, the diffuser arms being fixed to the outer cylindrical casing and each flame trap plate being radially positioned about the central rear cone and mounted so as to pivot on the corresponding diffuser arm.

According to features of the invention, each flame trap plate is made from a composite material and is fixed to the diffuser arm by means of a metal support clamp, the two plates of each pair having a cam forming a projection from their facing faces, said two cams bearing on one another.

According to another feature of the invention, each cam has an at least partly circular peripheral zone, so as to always be in contact with the corresponding cam during the rotation of the flame trap plates.

As a result of these features of the invention, it is ensured that the flame trap plates do not overhang and do not become exposed to excessive forces and stresses.

The device is mechanically balanced and also the cams fulfil a damping or shock absorbing function, so that the assembly has a good vibration behaviour.

Advantageously, the cam is in one piece with the flame trap plate and is made from a composite material. It is therefore possible to integrate this cam during the manufacture of the flame trap plate. This arrangement of the flame trap plate is consequently relatively simple and has a low cost compared with the advantages provided by this solution.

The invention is described in greater detail hereinafter relative to a non-limitative embodiment and the attached drawings, wherein show:

FIG. 1 a diagram illustrating in cross-section, the general structure of a prior art turbo-jet.

Figure 2:
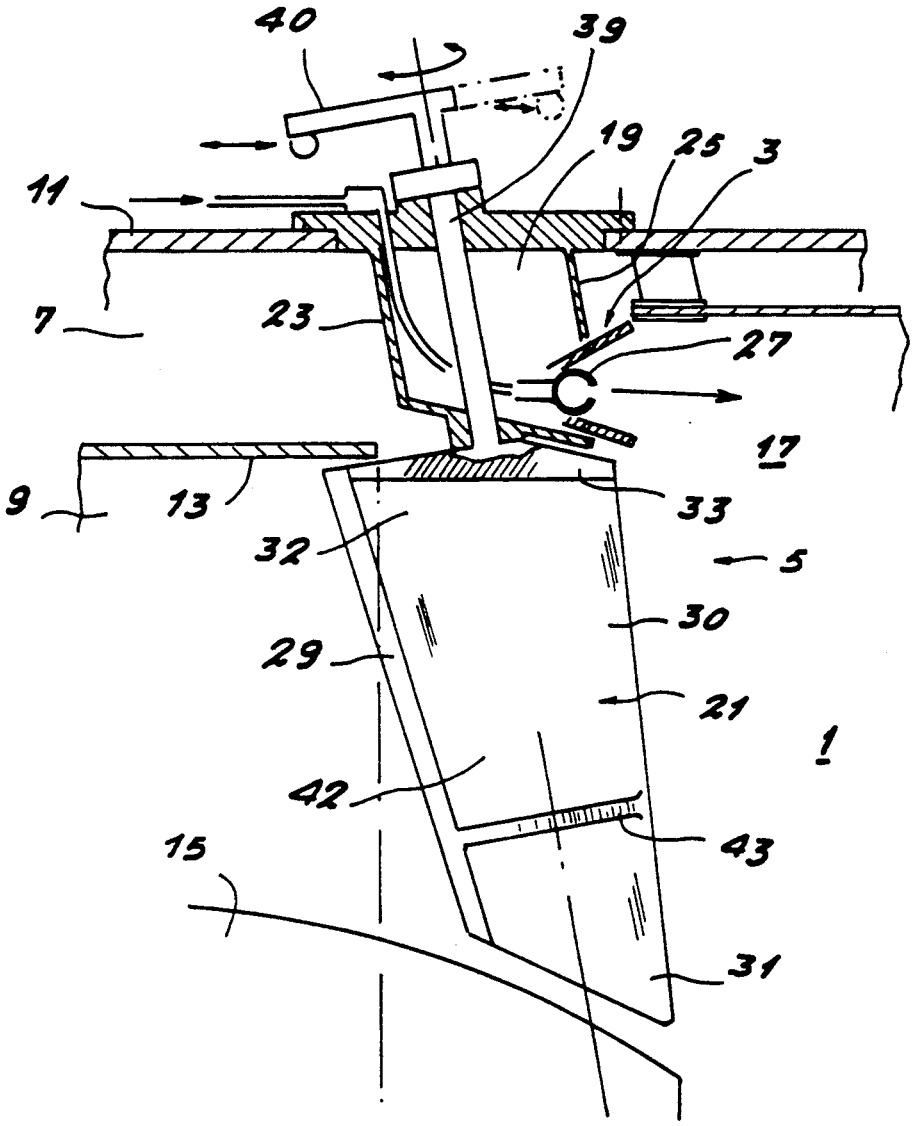

FIG. 2 a sectional view of part of the after-burner device according to the invention.

Figure 3:
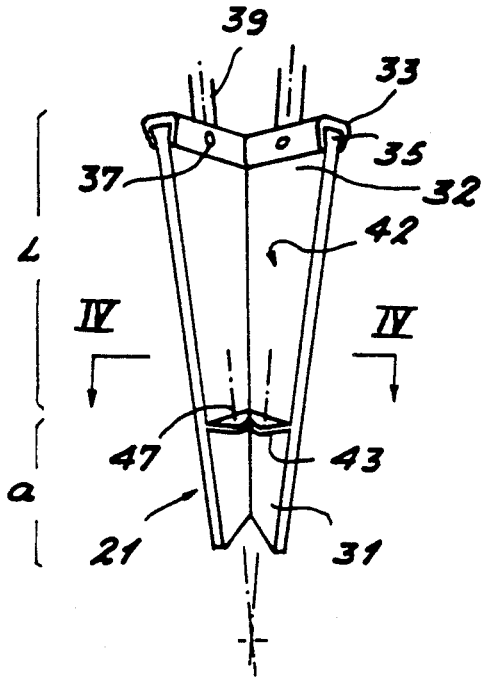

FIG. 3 a perspective view of the flame trap plates according to the invention.

Figure 4:
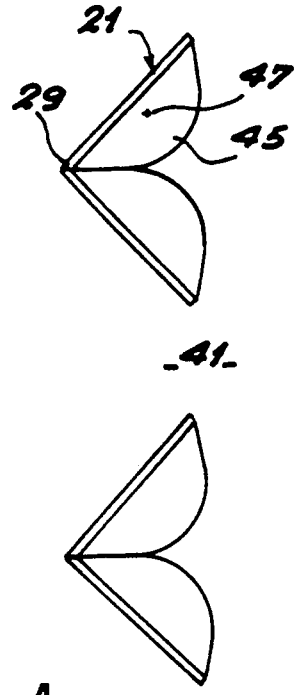
Figure 5:
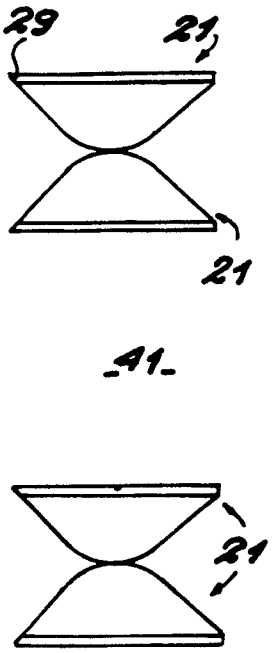

FIGS. 4 and 5 flame trap plates, seen in section along the line IV—IV of FIG. 3, respectively in the "after-burner" position and in the "dry engine" position.

As illustrated by FIG. 2, the variable geometry flame trap device according to the invention is intended for use in an after-burner device. The latter comprises an after-burner chamber 1, a fuel supply device 3 and the actual flame trap device 5. As described relative to FIG. 1, the after-burner chamber 1 is positioned downstream of the high and low pressure turbines and upstream of the air ejection jet pipes. More specifically and as illustrated in FIG. 2, said after-burner chamber 1 is simultaneously placed at the outlet of a secondary air flow duct 7 and a primary air flow duct 9. The secondary air flow duct 7 is defined by two walls respectively constituted by an outer cylindrical casing 11 and an inner cylindrical casing 13. Therefore said secondary flow duct is annular. The primary air flow duct 9 is defined on the one hand by the inner wall of the inner cylindrical casing 13 and on the other by a central rear cone 15 positioned downstream of the turbines. The primary and secondary air flows meet level with a zone, referred to as the confluence zone 17, located at the inlet of the after-burner chamber 1. The flame trap device 5 is positioned level with said confluence zone 17.

The flame trap device 5 comprises at least one plurality of diffuser arms 19 and several pairs of flame trap plates 21. More specifically, the diffuser arms 19 are positioned at the outlet of the secondary air flow duct 7, whilst the pairs of flame trap plates 21 are positioned at the outlet of the primary air flow duct 9. All the flame trap plates 21 are arranged radially around the central rear cone 15.

Each diffuser arm 19 is faired and has a leading edge 23 and a trailing edge 25. It is fixed by its radially outer part to the outer casing 11. This diffuser arm is hollow and metallic. The structure of said diffuser arm and its fixing method are of a conventional nature and need not be described here. Level with its trailing edge 25, said arm supports a burner ring 27 permitting the fuel supply to the after-burner chamber 1, said ring having a conventional structure.

This flame trap plate 21 also has a faired structure and therefore has a leading edge 29 and a trailing edge 30. These flame trap plates 21 are made from a composite material, preferably a composite ceramic material of type Si C/Si C. Their radially inner end 31 is free. However, their radially outer end 32 is fixed by means of a support clamp 33 to the diffuser arms 19. This fixing method is illustrated in FIG. 3.

The radially outer part 32 of the plate 21 has a widened, truncated cone-shape 35. The support clamp 33 is in the form of a channel, whose two ends are brought together so as to also have a truncated cone-shaped cross-section. The specific shape of said channel is designed so as to fit to the end part 35. An axial fixing pin 37 also traverses the support clamp 33 and the end portion 35. This pin prevents axial displacements of the flame trap plate 21, said displacements being induceable either by thermal conduction, or by vibration phenomena and might lead to the opening of the clamp 33.

In addition, a rotation shaft 39 is provided on the radially outer surface of the support clamp 33 and may or may not be offcentered with respect to the radially outer surface of said clamp 33. The shaft 39 traverses the diffuser arm 19 and the outer cylindrical casing 11, as illustrated in FIG. 2. The shaft 39 is connected to a rotation control device 40 and which in conventional manner is formed by a system of rings and rods driven by a jack. This system is of a conventional nature in connection with devices permitting the setting of vanes or blades in accordance with a variable pitch. It should also be noted that the support clamp 33 is flush with the inner cylindrical casing 13.

As illustrated in FIG. 3, these flame trap plates 21 are arranged in pairs. During the operation of the after-burner device in the after-burner mode, the flame traps permit a good flame stabilization. The pairs of flame trap plates 21 are arranged in the manner illustrated in FIG. 4, so that their respective leading edges 29 touch. These flame trap plates are consequently arranged in V-shaped manner in the flame front. The primary air flow striking these plate pairs 21 is deflected and must pass into the space 41 between two adjacent plate pairs, where it is accelerated or where turbulence is created (path illustrated by the arrows). When the device is operating in the dry engine mode, the flame trap plate pairs 21 are arranged in the manner illustrated in FIG. 5, i.e. their leading edges 29 no longer converge and are parallel to the gas flow.

As illustrated in FIG. 3, each flame trap plate 21 has on its inner face 42 a cam 43. The two inner faces of a plate pair are the facing faces. The cam 43 is preferably located in the lower half of the flame trap plate 21 and is made from the same composite material as the flame trap 21. Generally, the cam is made in one piece with the plate 21. These cams have a limited thickness and are provided with an at least partly circular, peripheral edge or rim 45, as illustrated in FIG. 4. It can be considered that the rotation center of each plate is located in the center of the cam 45, said rotation center being designated 47. The two cams 43 of each flame trap plate pair 21 face one another and are continuously in contact during the displacement between the after-burner position illustrated in FIG. 4 and the dry engine position shown in FIG. 5. As a result of the cams the two flame trap plates 21 bear against one another and pivot without deformation.

Thus, in the prior art, the flame trap plates 21 were arranged in overhanging manner and their radially inner ends 31 tended to deform on moving together. By appropriately positioning the cams 43, it can be found that the bending moments exerted at the end 35 of the plate 21 and at the cam 43 are equivalent. In order to have a constant thickness of the plate 21, it has been calculated that the bending moments were equal when $a=L(\sqrt{1/6})$, with a representing the distance between the cam 43 and the radially inner end 31 and L representing the distance between the cam 43 and the end portion 35 of the flame trap plate 21 (cf. FIG. 3). Although this position is preferred, it is possible to displace the cam 43 about this position.

Thus, whereas in the prior art, the flame trap plates 21 had to have a thickness of 8 mm to provide the necessary mechanical strength characteristics for the part, this thickness is now only 2.5 mm when using the cams 43. Thus, the plates 21 are thinner, lighter and produce less pressure drops in the dry engine position and consequently cause fewer aerodynamic problems.

We claim:

1. Variable geometry flame trap device for use in the after-burner device of a gas turbine, comprising a plurality of regularly distributed diffuser arms (19) and positioned at the outlet of a secondary air flow duct (7) defined between an outer cylindrical casing (11) and an inner cylindrical casing (13) and a plurality of regularly distributed flame trap plate pairs (21) and positioned at the outlet of a primary air flow duct (9) defined between said inner casing (13) and a central rear cone (15), the diffuser arms (19) being fixed to the outer cylindrical casing (11) and each flame trap plate (21) is positioned radially about the central rear cone (15) and mounted so as to pivot on the corresponding diffuser arm (19), characterized in that each flame trap plate (21) is made from a composite material and is fixed to the diffuser arm (19) by means of a metal support clamp (33) and in that the two plates (21) of each pair comprise a cam (43) projecting from their facing faces (42), said two cams (13) bearing on one another.

2. Variable geometry flame trap device according to claim 1, characterized in that each cam (43) has an at least partly circular peripheral rim (45), so as to always be in contact with the corresponding cam (43) during the rotation of the flame trap plates (21).

3. Variable geometry flame trap device according to claim 1 or 2, characterized in that the cam (43) is in one piece with the flame trap plate (21) and in that it is made from a composite material.

4. Variable geometry flame trap device according to claim 1 or 3, characterized in that the composite material is a ceramic material.

5. Variable geometry flame trap device according to claim 1, characterized in that the radially outer end (35) of the flame trap plate (21) is widened and is fitted into the support clamp (33) having a corresponding shape and in that an axial pin (37) substantially perpendicularly traverses said radially outer end (35) and the support clamp (33).

6. Variable geometry flame trap device according to claim 1 or 5, characterized in that a pivoting shaft (39) integral with the support clamp (33) traverses the corresponding diffuser arm (19).

7. Variable geometry flame trap device according to claim 1 or 6, characterized in that the diffuser arm (19) supports fuel supply means (3) in its downstream part.

* * * * *